US008087950B1

(12) United States Patent
Deng et al.

(10) Patent No.: US 8,087,950 B1
(45) Date of Patent: Jan. 3, 2012

(54) MOUNTING APPARATUS FOR MEMORY CARD

(75) Inventors: Ping-Chuan Deng, Shenzhen (CN); Zheng-Heng Sun, Tu-Cheng (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/071,481

(22) Filed: Mar. 24, 2011

(30) Foreign Application Priority Data

Jan. 28, 2011 (CN) ..... 2011 1 0031177

(51) Int. Cl.
*H01R 13/62* (2006.01)

(52) U.S. Cl. ..... 439/328

(58) Field of Classification Search ..... 439/328, 439/325, 326, 327, 157, 158, 372, 160
See application file for complete search history.

(56) References Cited

U.S. PATENT DOCUMENTS 4,872,853 A * 10/1989 Webster ..... 439/327
4,898,540 A * 2/1990 Saito ..... 439/153
5,417,580 A * 5/1995 Tsai ..... 439/328
5,577,922 A * 11/1996 Enomoto et al. ..... 439/157
5,584,705 A * 12/1996 Lin ..... 439/157
5,634,803 A * 6/1997 Cheng et al. ..... 439/157
6,045,385 A * 4/2000 Kane ..... 439/327
6,083,026 A * 7/2000 Trout et al. ..... 439/328
6,168,452 B1 * 1/2001 Lai et al. ..... 439/342
6,431,898 B1 * 8/2002 Asakawa ..... 439/325
6,599,142 B2 * 7/2003 Bu ..... 439/157
6,702,598 B1 * 3/2004 Lo ..... 439/157
7,252,523 B1 * 8/2007 Pennypacker et al. ..... 439/160
7,438,569 B2 * 10/2008 Pennypacker et al. ..... 439/157
7,661,974 B1 * 2/2010 Sun ..... 439/328
7,677,907 B2 * 3/2010 Guan et al. ..... 439/157
7,857,628 B2 * 12/2010 Chung et al. ..... 439/59

* cited by examiner

*Primary Examiner* — Tulsidas C Patel
*Assistant Examiner* — Harshad Patel
(74) *Attorney, Agent, or Firm* — Altis Law Group, Inc.

(57) ABSTRACT

A mounting apparatus for mounting a memory card includes a socket, a locking member attached to one end of the socket, and an operation member pivotably attached to the locking member. The operation member is used for operating the locking member to lock or release the memory card.

4 Claims, 5 Drawing Sheets

MOUNTING APPARATUS FOR MEMORY CARD

BACKGROUND

1. Technical Field

The present disclosure relates to mounting apparatuses and, more particularly, to a mounting apparatus for a memory card.

2. Description of Related Art

Referring to FIG. 5, a memory card is installed in a socket 100 of a motherboard. Two latch members 200 are attached to two opposite ends of the socket 100. Each latch member 200 includes a latch portion 201 for latching the memory card, and a handle 202 integrally extending outward from the latch portion 201 for operating the latch portion 201. The handle 202 may interfere with other elements on the motherboard when the other elements are arranged near the memory card, which means full use of space cannot be made of around socket 100.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings in which like references indicate similar elements, is illustrated by way of examples and not by way of limitation. It should be noted that references to "an" or "one" embodiment in this disclosure are not necessarily to the same embodiment, and such references mean at least one.

Figure 1:
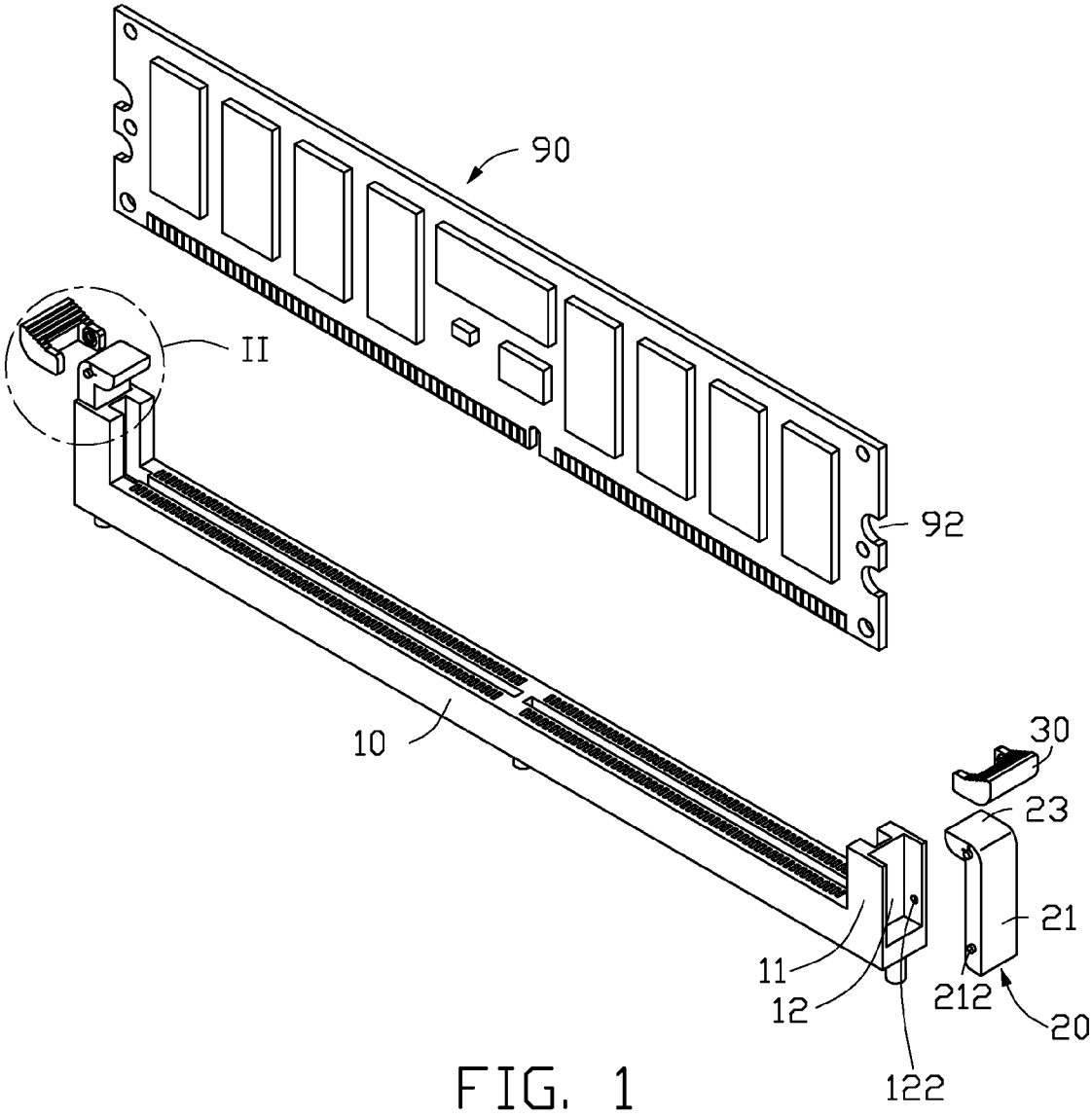
FIG. 1 is an exploded, isometric view of an embodiment of a mounting apparatus, together with a memory card.

Referring to FIG. 1, one embodiment of a mounting apparatus is provided to mount a memory card 90. The mounting apparatus includes a socket 10 mounted on a motherboard (not shown in pictures), two locking members 20, and two operation members 30. Two cutouts 92 are defined in opposite ends of the memory card 90, respectively.

Figure 2:
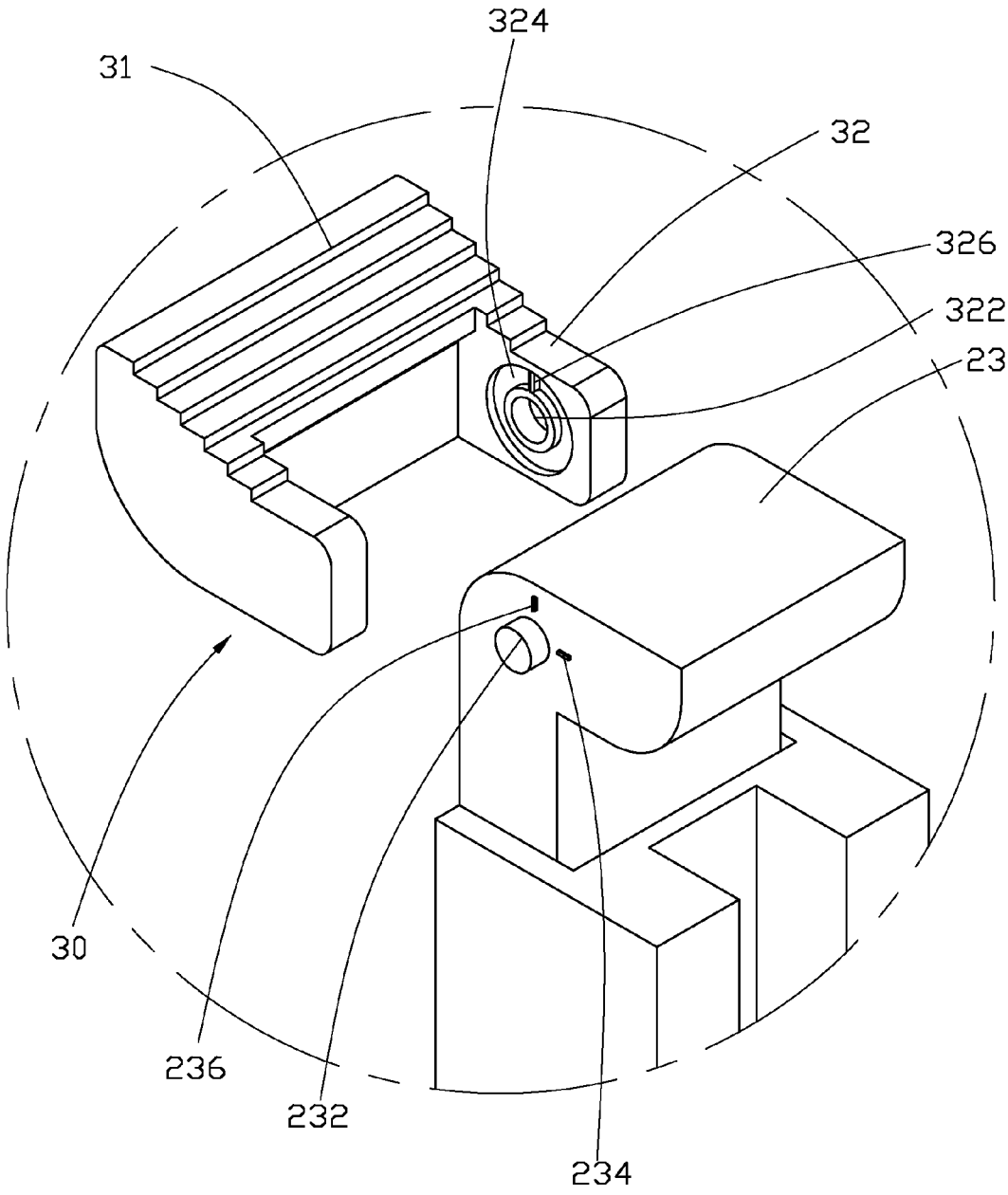
FIG. 2 is an enlarged view of the circled portion II of FIG. 1.

Referring to FIG. 2, a connecting portion 11 is formed on each end of the socket 10. A receiving portion 12 is defined in an outer surface of each connecting portion 11. Two mounting holes 122 are respectively defined in opposite inner surfaces of the receiving portion 12.

Each locking member 20 is substantially L-shaped, and includes a mounting portion 21 and a locking portion 23 substantially perpendicularly extending from a top of the mounting portion 21. Two tabs 212 extend from opposite side surfaces of a lower portion of the mounting portion 21, respectively. Two pivoting shafts 232 extend from opposite side surfaces of the locking portion 23, adjacent to a junction of the locking portion 23 and the mounting portion 21. A first positioning block 236 extends from the locking portion 23 above each pivoting shaft 232. A second positioning block 234 extends from the locking portion 23, beside the pivoting post 232, horizontal to the pivoting post 232, and opposite to the conjunction of the locking portion 23 and mounting portion 21. An extension direction of the first positioning block 236 is substantially vertical, and an extension direction of the second positioning block 234 is substantially perpendicular to the extension direction of the first positioning block 236.

Each operation member 30 includes a main body 31 and two parallel pivoting portions 32 respectively extending from opposite ends of one side of the main body 31. A plurality of skidproof pieces (not labeled) are formed on a top of the main body 31. Each pivoting portion 32 defines a pivot hole 322. An annular slot 324 is defined in each pivoting portion 32, around the pivot hole 322. A block 326 is formed in the slot 324.

Figure 3:
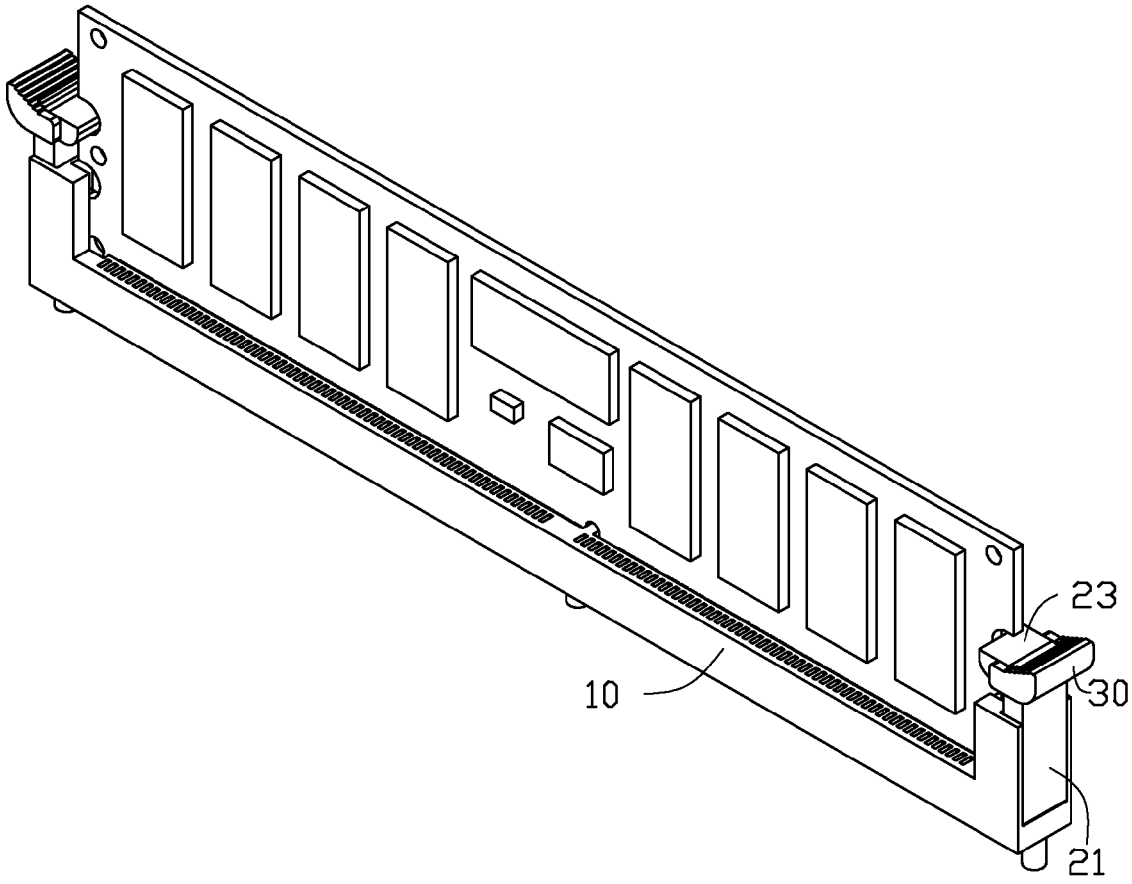
FIG. 3 is an assembled view of FIG. 1, showing a first use state.
Figure 4:
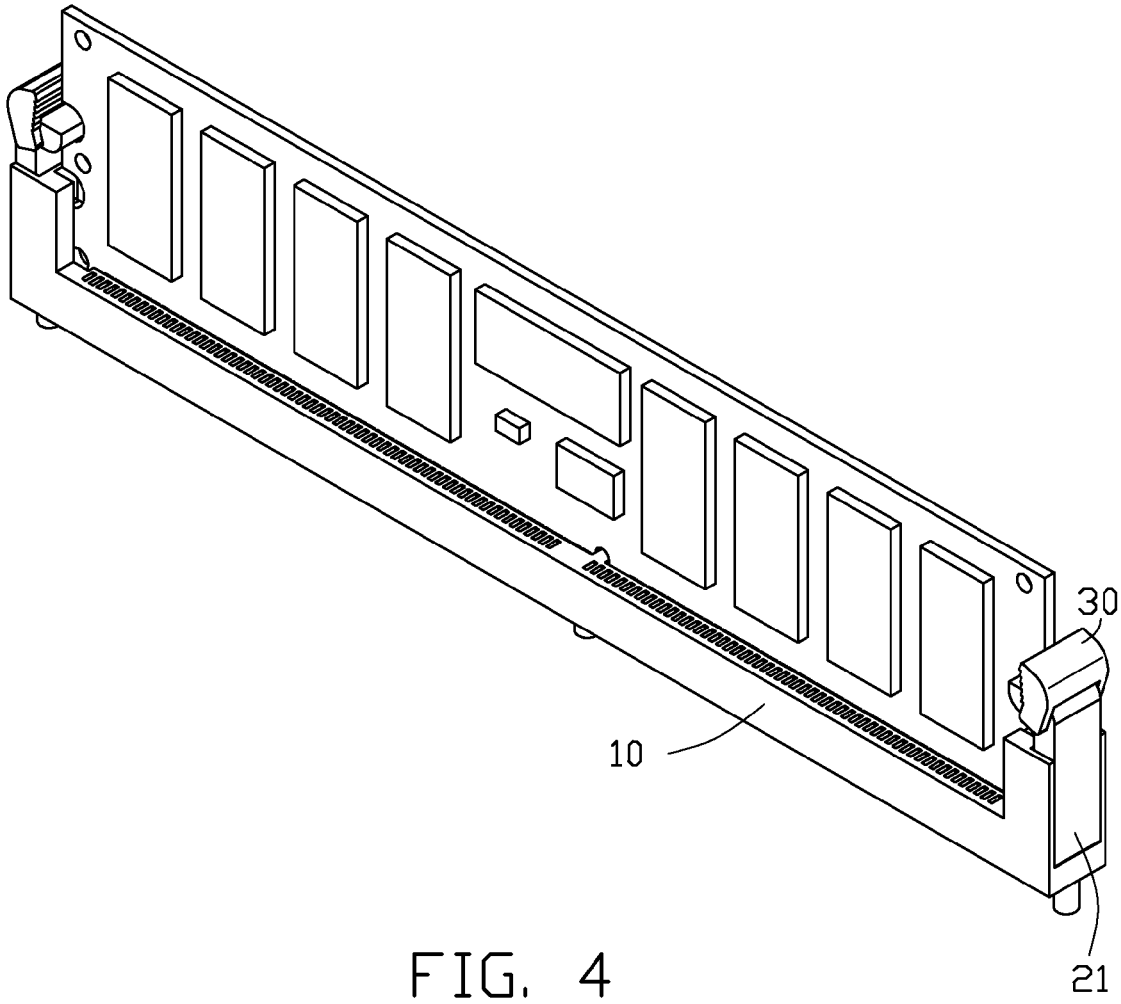
FIG. 4 is similar to FIG. 3, but showing a second use state.
Figure 5:
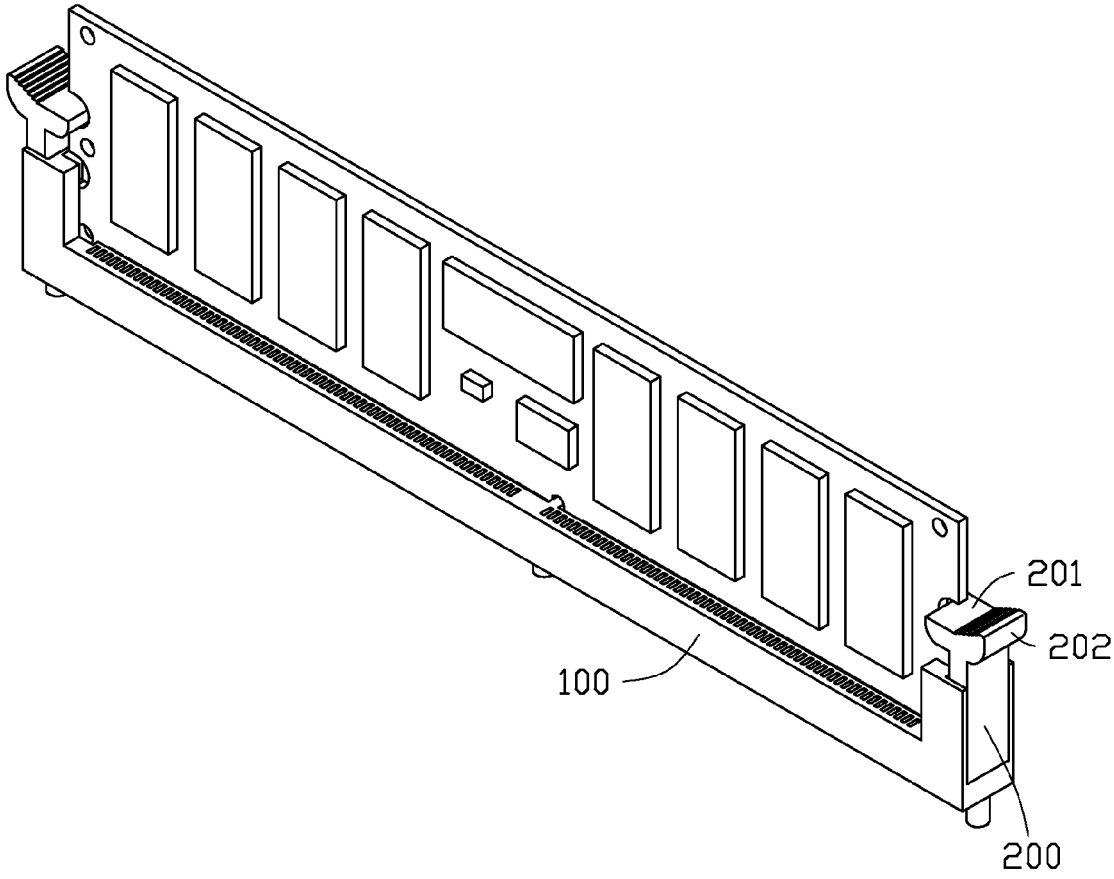
FIG. 5 (RELATED ART)
FIG. 5 is an exploded, isometric view of a related-art mounting apparatus, together with a memory card.

Referring to FIGS. 3 and 4, in assembly of the mounting portions 21, the tabs 212 are engaged in the corresponding mounting holes 122, to arrange the mounting portions 21 in the receiving portions 12. The pivoting shafts 232 of the locking members 20 are pivotably engaged in the pivot holes 322 of the operation members 30, thus the operation members 30 are pivotably attached to the corresponding locking member 20.

In use, the operation members 30 are pivoted outward, until the blocks 326 of the operation members 30 are blocked by the first positioning blocks 236. The operation members 30 are then further pushed outward to deform the mounting portions 21 outwards. The memory card 90 is plugged into the socket 10, the operation members 30 are released, the mounting portions 21 are restored, to make the locking portions 23 engage in the corresponding cutouts 92 of the memory card 90. The operation members 30 are pivoted toward the memory card 90, until the blocks 326 engage with the second positioning blocks 234, which saves space on the motherboard.

It is to be understood, however, that even though numerous characteristics and advantages of the embodiments have been set forth in the foregoing description, together with details of the structure and function of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A mounting apparatus for mounting a memory card, the mounting apparatus comprising:

a socket, comprising a connecting portion formed from an end of the socket;

a locking member attached to one end of the socket, wherein the locking member comprises a mounting portion and a locking portion, two tabs extend from opposite sides of the mounting portion, a receiving portion is defined in an outer side of the connecting portion for receiving the mounting portion of the locking member, two mounting holes are defined in opposite inner surfaces of the receiving portion, and the tabs of the locking member are engaged in the mounting holes; and an operation member pivotably attached to the locking member, operable to operate the locking member to lock or release the memory card;

wherein two pivoting shafts extend from opposite side surfaces of the locking portion, the operation member comprises a main body and two pivoting portions extending from one side of the main body, each of the pivoting portions defines a pivot hole for pivotably receiving the corresponding pivoting shaft; and wherein a first positioning block extends from the locking portion above the pivoting shaft, a second positioning block extends from the locking portion beside the pivoting shaft, an annular slot is defined in each pivoting portion around the corresponding pivot hole, a block is formed in the slot, the block is operable to slide between the first positioning block and the second positioning block.

2. The mounting apparatus of claim 1, wherein an extension direction of the first positioning block is substantially perpendicular to an extension direction of the second positioning block.

3. A mounting apparatus for mounting a memory card, the mounting apparatus comprising:

a socket, comprising a connecting portion formed from each of two opposite ends of the socket;

two locking members attached to opposite ends of the socket, wherein the locking members each comprises a mounting portion and a locking portion, two tabs extend from opposite sides of the mounting portion, a receiving portion is defined in an outer side of each of the connecting portions for receiving the mounting portions of the locking members, two mounting holes are defined in opposite inner surfaces of each of the receiving portions, and the tabs of each of the locking members are engaged in the corresponding mounting holes; and two operation members pivotably attached to corresponding locking members, operable to operate the locking members to lock or release the memory card;

wherein two pivoting shafts extend from opposite side surfaces of each of the locking portions, the operation members each comprise a main body and two pivoting portions extending from one side of the main body, each of the pivoting portions defines a pivot hole for pivotably receiving the corresponding pivoting shaft;

wherein a first positioning block extends from each of the locking portions above the corresponding pivoting shaft, a second positioning block extends from each of the locking portions beside the corresponding pivoting shaft, an annular slot is defined in each of the pivoting portions around the corresponding pivot hole, a block is formed in each of the slots, each of the blocks is operable to slide between the corresponding first positioning block and the corresponding second positioning block.

4. The mounting apparatus of claim 3, wherein an extension direction of each of the first positioning block is substantially perpendicular to an extension direction of the corresponding second positioning block.

* * * * *